US006029964A

United States Patent [19]

Bohl

[11] Patent Number: 6,029,964

[45] Date of Patent: Feb. 29, 2000

[54] CLAMP WITH SWIVEL PADS

[76] Inventor: Larry Bohl, 3707 S. 97th St., Omaha, Nebr. 68124

[21] Appl. No.: 09/081,965

[22] Filed: May 20, 1998

[51] Int. Cl.[7] ..... B25B 1/00

[52] U.S. Cl. ..... 269/6; 269/166; 269/258; 269/283

[58] Field of Search ..... 269/266, 6, 3, 269/166, 258–264, 274, 275, 279–284, 249

[56] References Cited

U.S. PATENT DOCUMENTS

| | | | |
|---|---|---|---|
| 291,248 | 1/1884 | West | 269/249 |
| 334,055 | 1/1886 | Shaw | 269/262 |
| D. 340,851 | 11/1993 | Sorensen . | |
| 449,987 | 4/1891 | Wies | 269/262 |
| 1,459,093 | 6/1923 | French | 269/249 |
| 1,497,107 | 6/1924 | Lasell | 269/249 |
| 2,519,107 | 8/1950 | Brown | 269/249 |
| 2,666,352 | 1/1954 | Philips | 269/265 |
| 4,240,621 | 12/1980 | Daddato | 269/264 |
| 4,353,537 | 10/1982 | Koufos . | |
| 4,569,511 | 2/1986 | Bell, Jr. . | |
| 4,619,447 | 10/1986 | Blake . | |
| 4,962,918 | 10/1990 | Yang | 269/249 |
| 5,078,372 | 1/1992 | Fitzpatrick . | |
| 5,143,359 | 9/1992 | Bush . | |
| 5,246,216 | 9/1993 | Oberst . | |
| 5,346,194 | 9/1994 | Coffin, III . | |
| 5,350,163 | 9/1994 | Lichtenberg . | |
| 5,427,364 | 6/1995 | Zborschil | 269/258 |
| 5,443,246 | 8/1995 | Peterson . | |

FOREIGN PATENT DOCUMENTS

| | | | |
|---|---|---|---|
| 2171035A | 8/1986 | United Kingdom | 269/259 |

*Primary Examiner*—Robert C. Watson
*Attorney, Agent, or Firm*—Zarley, McKee, Thomte Voorhees & Sease; Dennis L. Thomte

[57] ABSTRACT

A clamp with swivel pads includes a clamp with a rigid jaw and a moveable jaw, each jaw having a base plate thereon for receiving a gripping pad. At least one of the gripping pads is removably mounted on a swivel mechanism for swiveling the pad on the mechanism. The swivel mechanism is operably connected to one of the base plates to permit swivel movement of the pad relative to the base plate.

1 Claim, 4 Drawing Sheets

CLAMP WITH SWIVEL PADS

TECHNICAL FIELD

The present invention relates generally to clamping apparatus, and more particularly to an improved removable swivel pad for the gripping pads of a clamp.

BACKGROUND OF THE INVENTION

There are a wide variety of clamping apparatus available on the market today. Several types have jaws with removable protective pads which protect the surface of the object being clamped from indentations and other markings from the clamp jaws.

SUMMARY OF THE INVENTION

It is a general object of the present invention to provide removable pads which are capable of swivel movement for existing clamp jaws.

Another object is to provide swivel pads which may be selectively locked in a swieveled position, on a removable pad for a clamp.

A further object of the present invention is to provide swivel pads for a clamp which are simple to use, economical to manufacture, and refined in appearance.

These and other objects of the present invention will be apparent to those skilled in the art.

The clamp with swivel pads of the presetn invention includes a clamp with a rigid jaw and a moveable jaw, each jaw having a base plate thereon for receiving a gripping pad. At least one of the gripping pads is removably mounted on a swivel mechanism for swiveling the pad on the mechanism. The swivel mechanism is operably connected to one of the base plates to permit swivel movement of the pad relative to the base plate.

DESCRIPTION OF THE PREFERRED EMBODIMENT

Figure 1:
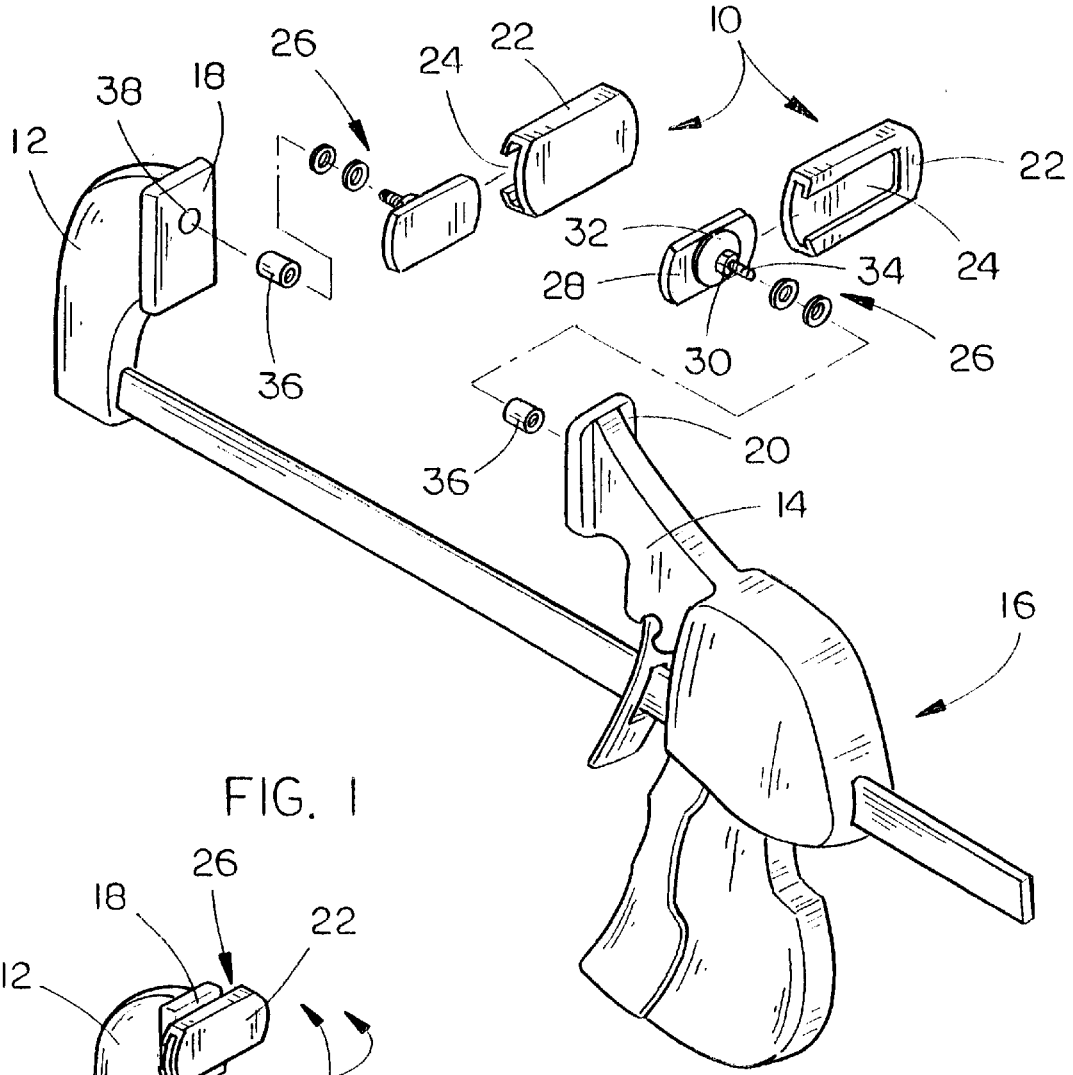
FIG. 1 is a perspective view of a clamp with the swivel pads of the present invention shown in exploded perspective view.

Referring now to the drawings, in which similar or corresponding parts are identified with the same reference numeral, and more particularly to FIG. 1, the removable swivel pads of the present invention designated generally at 10 and are shown attached to the jaws 12 and 14 of a conventional clamp 16. Jaw 12 is a fixed jaw, while jaw 14 is selectively movable towards and away from jaw 12.

Each jaw 12 and 14 includes a base plate 18 and 20 thereon arranged in parallel relationship. Each base plate 18 and 20 is typically designed to receive a resilient gripping pad 22 thereon. Each gripping pad 22 has a slot 24 formed in one end thereof which will receive the base plates 18 or 20 to retain the pad in position on either base plate.

The inventor herein has provided a swivel mechanism 26 which is inserted between each base plate 18 and 20 and its associated gripping pad 22 to permit swiveling movement of the gripping pads 22.

Each swivel mechanism 26 includes an attachment plate 28 of a size and shape similar to base plates 18 and 20, to removably receive a gripping pad 22 thereon. A ball 30 is operably mounted within a socket 32 attached to a rearward face of attachment plate 28. A threaded shaft 34 extends from ball 30 to permit connection of swivel mechanism 26 to each jaw 12 and 14. An interiorly threaded collar 36 is mounted in an aperture 38 formed directly in the opposing faces of base plates 18 and 20. In this way, each threaded shaft 34 may be threaded into a collar 36 to attach the swivel mechanism 26 to jaws 12 and 14. Each gripping pad 22 is then slid into position on the associated attachment plate 28 to permit universal swivel movement on swivel mechanism 26.

Figure 2:
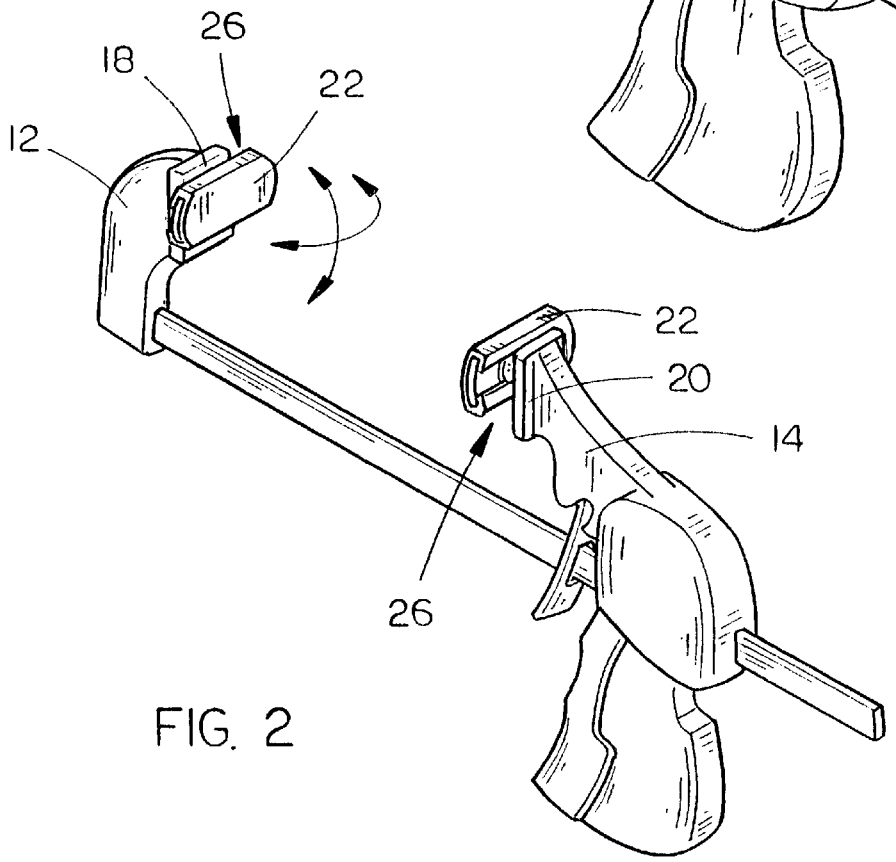
FIG. 2 is a perspective view of the clamp with the pads in operable position thereon.

Referring now to FIG. 2, it can be seen that each swivel pad 22 may be rotated and pivoted relative to the base plates 18 and 20, to permit a secure grip on irregularly shaped pieces. In addition, the swivel mechanisms 26 may be easily removed from jaws 12 and 14, and the gripping pads 22 replaced on base plates 18 and 20, to permit conventional operation of clamp 16.

Figure 3:
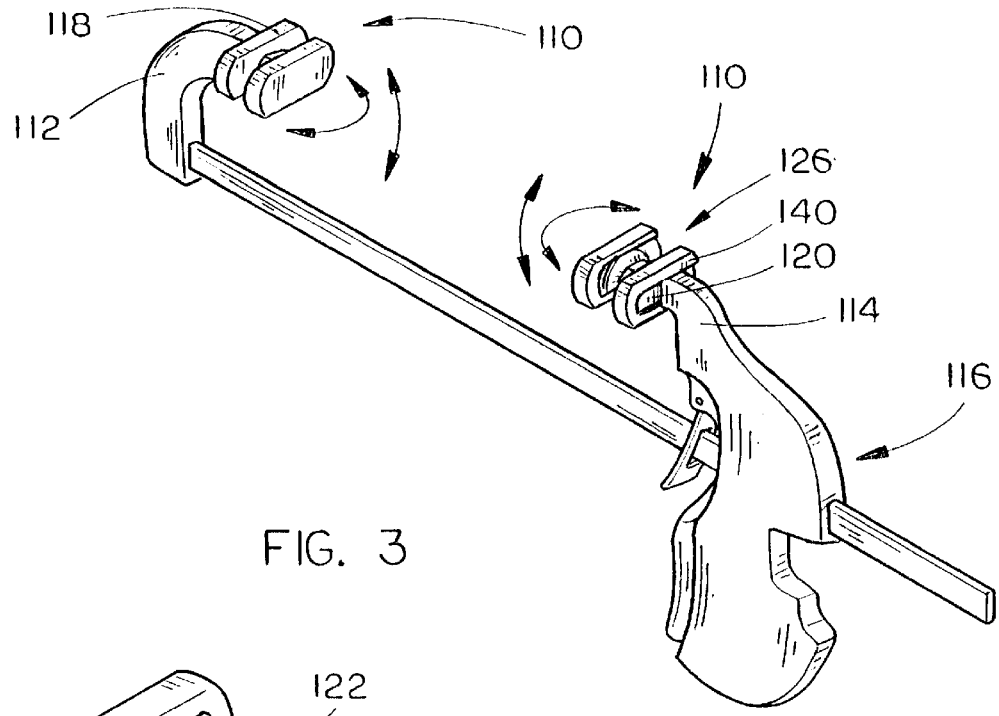
FIG. 3 is a perspective view of a clamp with a second embodiment of the swivel pads of the present invention.
Figure 4:
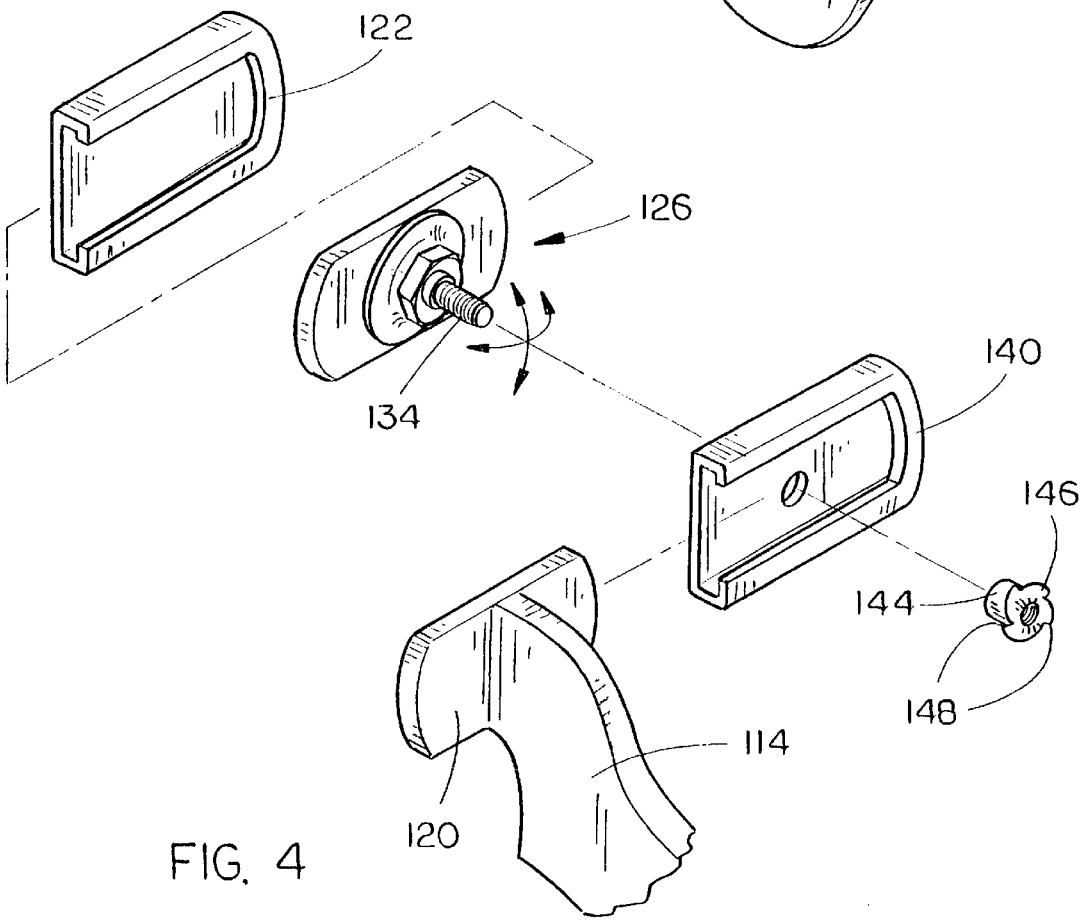
FIG. 4 is an enlarged exploded perspective view of one swivel pad of the second embodiment of the invention.

Referring now to FIGS. 3 and 4, a second embodiment of the swivel pads are designated generally at 110. The same swivel mechanism 126 is utilized in this second embodiment of the swivel pads 1 10, but the swivel mechanism 126 is attached to a second pad 40 hereinafter referred to as attachment pad 40. As shown in FIG. 4, attachment pad 140 is identical in shape and size to gripping pads 122, but has a central aperture 142 therethrough for receiving the threaded shaft 134 of swivel mechanism 126. An interiorly threaded collar 144 has a projecting flange 146 with teeth 148 for engaging the surface of attachment pad 140. Thus, threaded rod 134 is threaded into collar 144, and collar 144 is retained in position on attachment pad 140 by flange 146 and teeth 148. Attachment pad 140 may then be simply engaged in a conventional fashion on the base plates 118 or 120 of clamp 116 to provide the clamp with swivel pads 110.

Figure 5:
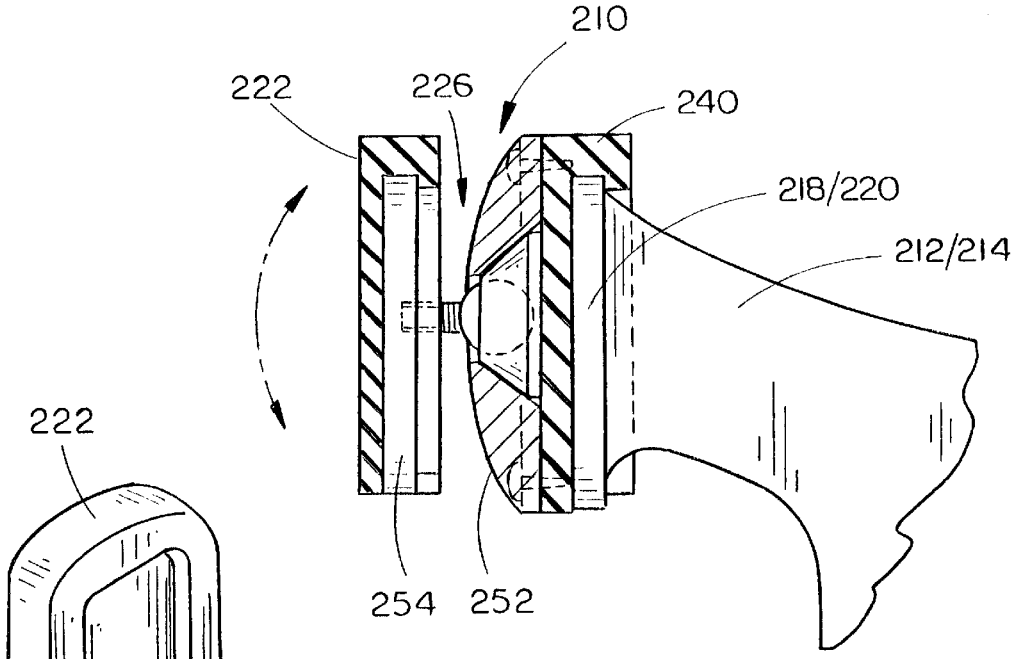
FIG. 5 is a sectional view through a third embodiment of a swivel pad of the present invention.
Figure 6:
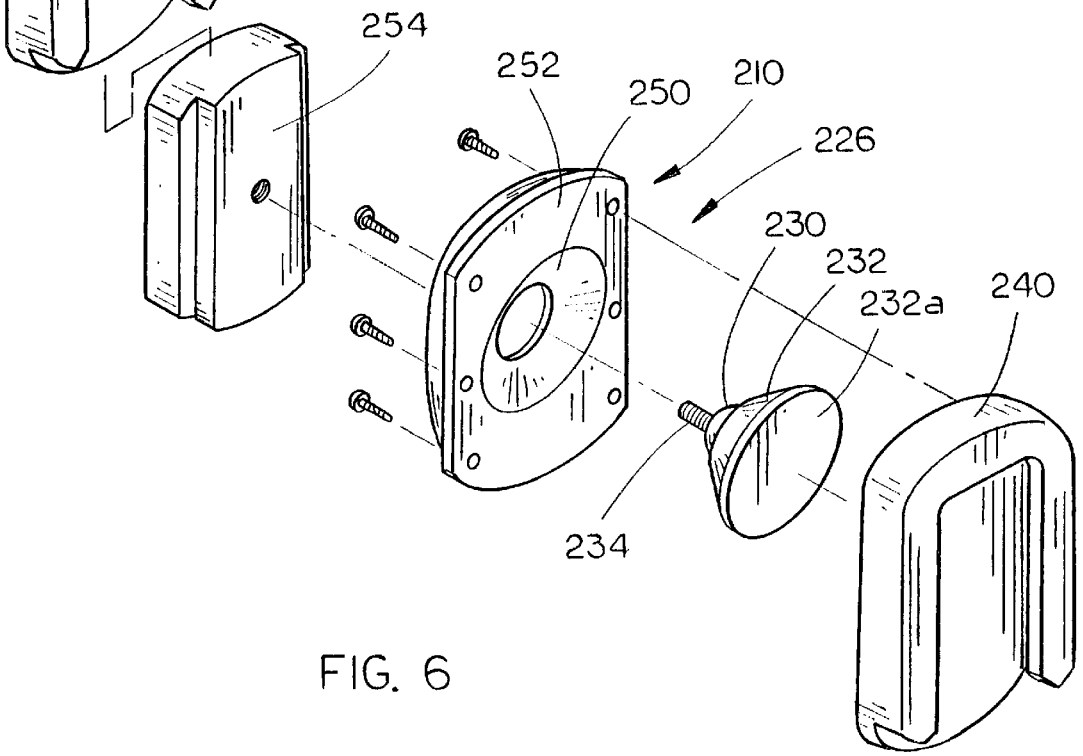
FIG. 6 is an enlarged exploded perspective view of the pad shown in FIG. 5.

Referring now to FIGS. 5 and 6, a third embodiment of the swivel pads is designated generally at 210. The third embodiment of swivel pads 210 differs from the previous two embodiments in the swivel mechanism 226. Swivel mechanism 226 includes a cone-shaped socket portion 232 with a ball 230 rotatably mounted in the apex of the cone. Threaded shaft 234 projects from ball 230 in the same manner as the previously described swivel mechanisms 26 and 126. Socket portion 232 is journaled through a cone-shaped depression 250 in a rearward face of a base block 252. Base block 252 is attached to the face of attachment pad 240 with screws or the like, with the flat base 232a of socket portion 232 in flush contact with attachment part 240.

The projecting end of threaded shaft 234 is threaded into an aperture on a support plate 254 which is shaped to receive the gripping pad 222 thereon. Thus, swivel 210 may be removably mounted on a base plate 218/220 on a jaw 212/214, without any other modification to the jaws 212/214.

Figure 7:
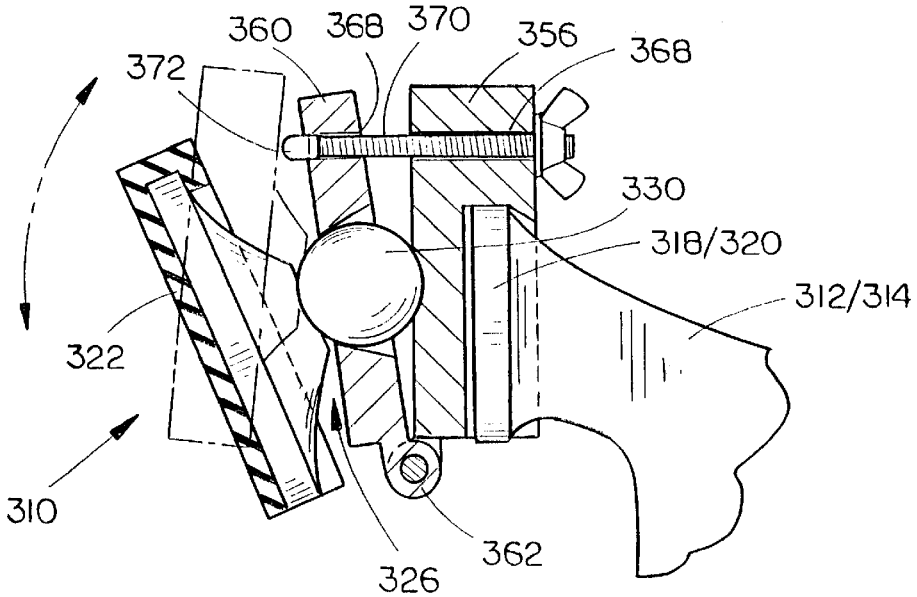
FIG. 7 is a vertical sectional view through a fourth embodiemnt of the swivel pad of the present invention.
Figure 8:
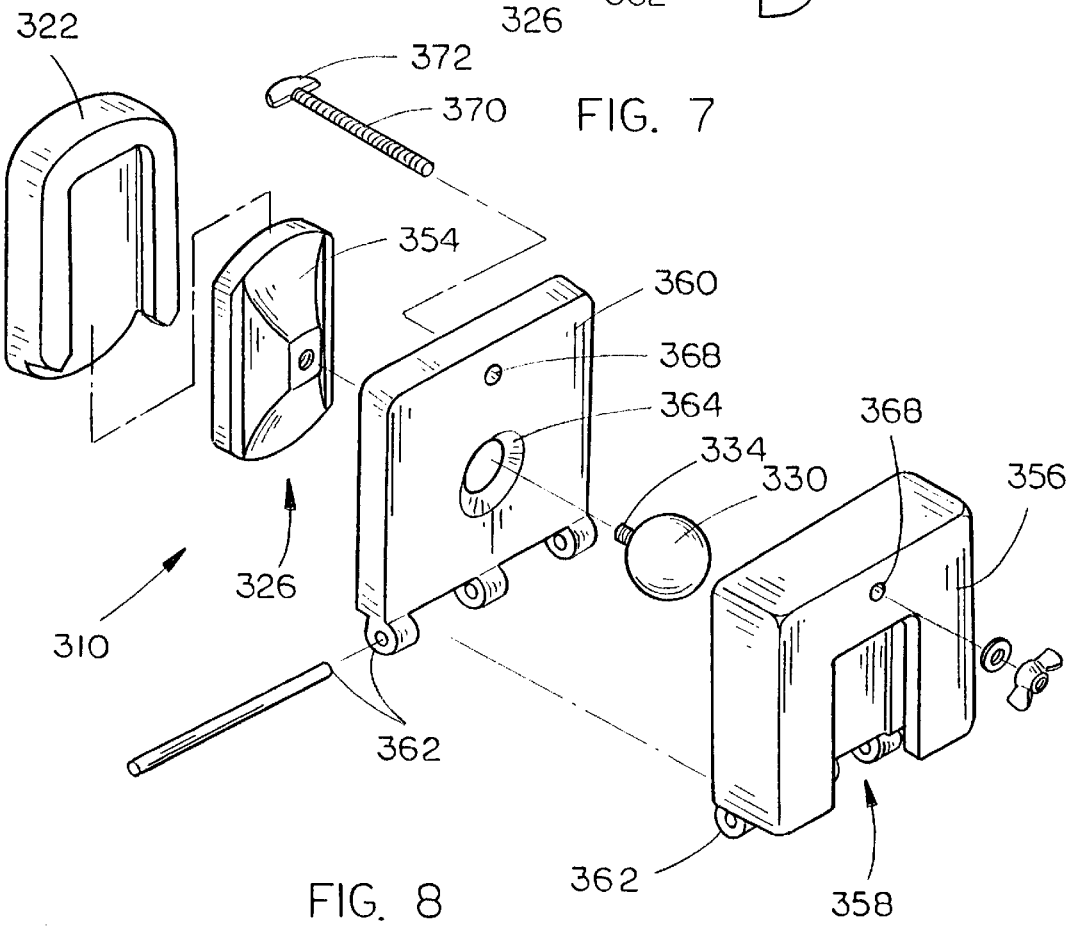
FIG. 8 is an enlarged exploded perspective view of the swivel pad shown in FIG. 7.

Referring now to FIGS. 7 and 8, a fourth embodiment of the swivel pads of the present invention is designated generally at 310. This embodiment of the invention provides a locking capability for securing the gripping pad 322 in a desired swiveled position. Swivel pad 310 includes an attachment housing 356 having a slot 358 therein designed to receive the base plate 318/320 of a clamp jaw 312/314.

A pivot plate 360 is pivotally connected by a hinge 362 along a lower edge of housing 356. The swivel mechanism 326 of the fourth embodiment of the invention includes a ball 330 with a projecting threaded shaft 344 rotatably mounted within a cone-shaped depression 364 in pivot plate 360. Shaft 334 projects through an aperture 366 in depression 364, and is threaded into a support plate 354 to permit swiveling of the support plate on ball 330 in depression 364.

As shown in FIG. 7, ball 330 has a rearward surface which projects outwardly from the rearward face of pivot plate 360. This rearward surface of ball 330 is in contact with a forward surface of housing 356. In order to secure the support plate 354 in a particular swiveled position, the housing 356 and the pivot plate 360 are provided with aligned apertures 368. A threaded rod 370 is joumaled through both apertures 368 and has an enlarged stop 372 at one end thereof. A wing nut 374 and washer 376 are selectively secured on the projecting end of rod 370 and may be tightened to squeeze pivot plate 360 towards housing 356, and thereby prevent rotational movement of ball 330, to thereby lock the swivel mechanism 26 in a swiveled position.

Whereas the invention has been shown and described in connection with the preferred embodiment thereof, many modifications, substitutions and additions may be made which are within the intended broad scope of the appended claims.

I claim:

1. In combination:

a clamp having a rigid jaw and a movable jaw, each jaw having a base plate thereon for receiving a gripping pad;

a first gripping pad removably mounted on a first swivel mechanism for swiveling said first pad on said first swivel mechanism;

said first swivel mechanism operably connected to said base plate on one of said rigid and movable jaws;

a second gripping pad removably mounted on a second swivel mechanism for swiveling said second pad on said second swivel mechanism;

said second swivel mechanism operably connected to said base plate on the other of said rigid and movable jaws;

each swivel mechanism including an attachment pad removably mounted on each said base plate;

a base block mounted on each said attachment pad, each having a cone-shaped depression in one face thereof;

a cone-shaped socket journaled in each said depression, with a ball rotatably mounted in each said socket;

a threaded shaft mounted on each said ball and projecting therefrom for rotation with said ball;

each said base block having an aperture formed in said depression, with said shaft projecting therethrough; and a support plate mounted on the projecting end of each shaft with said gripping pad removably mounted thereon.

* * * * *